United States Patent [19]

Shapiro et al.

[11] 3,941,619

[45] Mar. 2, 1976

[54] PROCESS FOR IMPROVING THE ELONGATION OF GRAIN REFINED COPPER BASE ALLOYS CONTAINING ZINC AND ALUMINUM

[75] Inventors: Eugene Shapiro, Hamden; Jacob Crane, Woodbridge, both of Conn.

[73] Assignee: Olin Corporation, New Haven, Conn.

[22] Filed: May 12, 1975

[21] Appl. No.: 576,690

[52] U.S. Cl. ..... 148/11.5 R

[51] Int. Cl.[2] ..... C22D 1/08

[58] Field of Search..... 148/11.5 C; 75/157.5, 162

[56] References Cited

UNITED STATES PATENTS

| | | | |
|---|---|---|---|
| 3,788,902 | 1/1974 | Shapiro et al. | 148/11.5 C |
| 3,816,187 | 6/1974 | Smith et al. | 148/11.5 C |
| 3,841,921 | 10/1974 | Shapiro et al. | 148/11.5 C |
| 3,852,121 | 12/1974 | Crane et al. | 148/11.5 C |
| 3,882,712 | 5/1975 | Shapiro et al. | 148/11.5 C |

*Primary Examiner*—W. Stallard

*Attorney, Agent, or Firm*—Robert H. Bachman; David A. Jackson

[57] ABSTRACT

A process for improving the elongation of copper base alloys containing about 2 to 4.5% aluminum, 15 to 31% zinc, and a grain refining element such as iron, chromium, zirconium, or cobalt, is carried out through controlled grain coarsening. Such alloys are subjected to a cold reduction of about 15 to 40%, an intermediate anneal at about 625° to 725°C., a final cold reduction of 12 to 45% and a final anneal at about 600° to 725°C. Alternatively, the above sequence may be preceded by a preliminary cold reduction of about 10 to 70% and then a preliminary low temperature anneal at about 400° to 600°C. followed by the above reductions and anneals.

15 Claims, No Drawings

PROCESS FOR IMPROVING THE ELONGATION OF GRAIN REFINED COPPER BASE ALLOYS CONTAINING ZINC AND ALUMINUM

BACKGROUND OF THE INVENTION

The addition of elements acting as grain refiners to various solid solution, single-phase alloys has been used for the purpose of maintaining a fine grain size in the alloy during processing from the original casting to the final wrought product, thus serving to improve processing steps and/or to attain improved properties. In most cases, the grain refiner tends to maintain uniform alloy properties over a range of compositions and of processing conditions. At times, however, as with copper base alloys containing aluminum, zinc, and a grain refining element such as cobalt, the grain refining action is not adequately effective over the full range of operating temperatures up to the melting point of the alloys.

Copper base alloys containing grain refiners generally tend to maintain a fine grain size over a range of annealing temperatures, and display relatively small variations in mechanical properties in these ranges. While this is a desirable feature, it is accompanied by definite restrictions in the normally available ductility of the alloy. In contrast thereto, when a solid solution, single-phase alloy without grain refiners is subjected to higher annealing temperatures, the grain size and the ductility of the alloy increase and the strength decreases.

It is common practice to anneal at the highest temperature consistent with strength requirements to obtain material which requires unusually high ductility in forming operations such as stretch forming. The annealing temperature is further limited for fabricating parts which require a highly polished surface in that above a certain grain size, an "orange peel" condition occurs during fabrication which detracts from the appearance of the polished surface.

It is an undesirable feature of many grain refined copper base alloys that any attempt to coarsen the grain size above the stable level imposed by the grain refining addition results in an uncontrolled mixed grain size consisting of very small and abnormally large grains. Such irregular grain growth is caused by factors such as secondary recrystallization which are a direct result of the effect of the second phase particles on the matrix during cold working and subsequent annealing. Material subjected to irregular grain growth is not suitable for fabrication into parts requiring smooth surfaces for buffing and electroplating and is also characterized by nonuniformity of mechanical properties.

SUMMARY OF THE INVENTION

In accordance with this invention, a process has been developed which permits certain grain refined copper base alloys to achieve uniform enhanced ductility with a controlled grain size. The process comprises the treatment of annealed metal by a sequence of controlled cold reduction steps, each followed by a high temperature anneal carried out within critical temperature limits. The process in accordance with this invention is particularly applicable to copper base alloys containing about 2 to 4.5% aluminum, 15 to 31% zinc, and a grain refining element selected from the group consisting of iron 0.001 to 3%, chromium 0.001 to 1%, zirconium 0.001 to 1%, cobalt 0.001 to 3%, and mixtures of these grain refining elements, and balance essentially copper.

The alloys processed in accordance with this invention provide markedly improved elongation with a substantially uniform small grain size.

Therefore, it is an object of this invention to provide a process for improving the ductility of grain refined copper base alloys containing zinc and aluminum without causing irregular grain growth.

It is a further object of this invention to provide a process as above wherein the alloy is subjected to a defined sequence of cold reduction steps, each followed by a high temperature anneal.

It is a further object of this invention to provide a process as above which comprises a final cold reduction step followed by a high temperature anneal.

Another object of the invention is the provision of a sequence of treatments of such copper alloys containing grain refiners whereby high ductility and uniform tensile properties may be readily obtained.

Other objects and advantages will become apparent to those skilled in the art as a detailed discussion of particular embodiments follows.

DETAILED DESCRIPTION

In accordance with this invention, a process has been developed which permits grain refined copper base alloys containing aluminum and zinc to achieve improved ductility with a uniformly coarsened grain size.

The process is particularly applicable to copper base alloys containing about 15 to 31% zinc, 2 to 4.5% aluminum, and a grain refining element selected from the group consisting of iron 0.001 to 3%, chromium 0.001 to 1%, zirconium 0.001 to 1%, cobalt 0.001 to 3%, and mixtures of these elements, and balance essentially copper. Preferably, the alloy contains 21 to 25% zinc, 2 to 4.5% aluminum, 0.2 to 0.7% cobalt or its equivalent, and balance essentially copper.

It has been found that the process of this invention is particularly applicable to CDA Alloy 688 containing 72.3 to 74.7% copper, 3.0 to 3.8% aluminum, 0.25 to 0.55% cobalt, and the balance essentially zinc.

It is desirable in accordance with this invention to provide the aforenoted copper base alloys in the wrought condition with improved ductility, as, for example, at least 40% and up to about 50% elongation for CDA Alloy 688 and similar alloys, without their being subject to irregular grain growth.

In accordance with a preferred embodiment of this invention, an alloy within the aforenoted ranges of composition is provided in the annealed condition, the alloy having been annealed at a temperature of less than 600°C. The annealed alloy is subjected to a cold reduction of about 15 to 40%, preferably of 20 to 35%. The cold worked alloy is then subjected to a high temperature anneal at 625° to 725°C., preferably at about 650° to about 700°C. A final cold reduction of 12 to 45%, preferably 15 to 35%, and a final anneal at 600° to 725°C., preferably 675° to 725°C., are then applied.

It has been found that the elongation increases with increasing temperatures in the final annealing step. The aforenoted process yields a wrought alloy having a substantially uniform grain size of less than 0.030 millimeters, an ultimate tensile strength of at least about 70 ksi, a 0.2% yield strength of at least about 30 ksi, and an elongation of at least 40%. It has been possible to achieve with CDA Alloy 688 elongations as high as 50% or over, ultimate tensile strengths up to about 74 ksi, and a 0.2% yield strength of up to about 40 ksi.

In accordance with preferred embodiments of this invention, the process is carried out in a sequence of cold reductions interspersed with relatively high temperature anneals. However, such sequence may be preceded by a preliminary cold reduction of about 10 to 70%, for example 45%, followed by a preliminary low temperature anneal at about 400° to 600°C., for example at 575°C. As with the process of the preceding embodiment, elongation increases with the temperature of the final anneal, and properties are obtained similar to those set forth above.

It is emphasized, however, that the intermediate and final annealing temperatures are critical, as the use of temperatures below 600°C. for these steps results in inadequate increases of elongation and ductility, and undue dependence of tensile properties on composition, thereby limiting the flexibility with respect to process conditions.

The need for a high temperature annealing treatment following the intermediate 15 to 40% cold reduction is particularly noteworthy, in view of the undesirable results thereby obtained in treating copper-base alloys differing somewhat in composition. As shown in U.S. Pat. No. 3,788,902 issued Jan. 29, 1974, a low temperature intermediate anneal is required in uniformly attaining high ductility in CDA Alloy 638, as the use of temperatures above 600°C. for this step result in exaggerated grain growth therein. This alloy contains 2.5 to 3.1% aluminum, 0.25 to 0.55% cobalt, 1.5 to 2.1% silicon, and balance copper.

In all of the embodiments discussed in accordance with this invention, the final cold working and final annealing steps are critical to obtain a wrought alloy having improved elongation without irregular grain growth. The processes of this invention provide uniform grain coarsening and substantially uniform grain sizes of less than 0.030 millimeters. If the upper limit for the final annealing temperature is exceeded in accordance with this invention, the alloy is subject to irregular grain growth. This is similarly the case with respect to the final cold working step, as a reduction of greater than 45% will result in the onset of irregular grain growth. Annealing or cold working at below the specified lower limits result in inadequate ductility and other physical properties.

While the invention has been described with respect to preferred embodiments, other process steps may be performed prior to those described in some detail, but it is essential that the intermediate cold reduction and annealing steps and the final cold working and annealing steps are carried out as prescribed.

In the case of alloys of higher aluminum contents, cooling, after anneals, is best effected at a rate of 30° to 75° per hour from annealing temperature to about 500°C. and then at any convenient rate to ambient temperatures, in order to make certain that any separated beta phase is redissolved. Generally, however, the times at temperature and the heat up and cool down rates for the annealing steps of this invention are not critical and may be set as desired in accordance with conventional practice for these types of alloys, annealing times of 15 minutes to 1 hour usually being adequate to accomplish the desired recrystallization.

The processes of the invention will now be illustrated by reference to specific examples.

In the examples, the metal alloy samples were held at temperature for 1 hour, the temperature for each anneal referring to the temperature of the metal.

In the examples, the test results were obtained on the following representative alloy compositions, the values indicating weight percentages:

| | Zn | Al | Co | Cu |
|---|---|---|---|---|
| A | 22.6 | 3.2 | 0.42 | balance |
| B | 22.6 | 3.5 | 0.38 | " |
| C | 22.3 | 3.8 | 0.44 | " |

EXAMPLE I (A)

Each of the above alloys was converted by commercial means to 0.090 inch gage strip, in recrystallized form after annealing at 575°C. They were then treated in accordance with the process sequences as indicated in Table I which lists the measured property values, including those for a comparison CDA 688 alloy sample after representative processing as shown. For each sample, the mechanical properties are given in the sequence UTS in ksi/0.2%YS in ksi/%El, where UTS is ultimate Tensile Strength, YS is Yield Strength, and El is Elongation.

TABLE I

| Process Sequence | Final Anneal Temp. | A | B | C |
|---|---|---|---|---|
| (1) | 575°C. | 75/42/37 | 71/33/45 | 74/37/42 |
| (1) | 650°C. | 75/40/38 | 72/33/47 | 72/35/42 |
| (1) | 700°C. | 72/36/41 | 69/29/46 | 70/30/47 |
| (1) | 725°C. | 72/34/44 | 70/31/50 | |
| (2) | Comparison CDA 688 80–85/48–55/35–38 | | | |

Process sequences:
(1) CR 45%, 575°C., CR 30%, 575°C., CR 15%, Final Anneal.
(2) CR 50%, 575°C., CR 50%, 575°C.,
where CR indicates cold reduction and °C. indicates annealing temperature.

In all the above samples, the grain size was uniform and less than 0.030 mm. and established the fact that the final anneal may advantageously be carried out at a high temperature without the occurrence of exaggerated grain growth. However, the resulting increase in ductility, as reflected in the elongation values, was indicated as dependent on aluminum content and generally not as great as desired in view of the decrease in other properties.

EXAMPLE I (B)

Raising the intermediate annealing temperature to 700°C. resulted in the data listed in Table II.

TABLE II

| Process Sequence | A | B | C |
|---|---|---|---|
| (1) | 72/36/41 | 69/29/46 | 70/30/47 |
| (3) | 66/29/49 | 64/25/52 | 63/22/50 |

(3) CR 45%, 575°C., CR 30%, 700°C., CR 15%, 700°C.

It is clear that this procedure effects the desired substantial increase in ductility, while any sensitivity to the aluminum content has been overcome. In all cases, the grain sizes were uniform and less than 0.030 mm.

EXAMPLE II (A)

This example furnishes a direct comparison of the effect of changes in the step of cold reduction before the final anneal in the process sequences (1) and (3), thus providing a comparison between carrying out the intermediate anneal at a low temperature (575°C.) and at a high temperature (700°C.). Table III lists the results of varying the final cold reduction in process (1).

TABLE III

| FCR | A | C |
|---|---|---|
| 10% | Exaggerated Grain Growth | |
| 15% | 72/36/41 | 70/30/47 |
| 25% | 73/36/41 | 70/31/47 |
| 40% | Exaggerated Grain Growth | |

Except as indicated, all grain sizes were uniform and less than 0.030 mm.

EXAMPLE II (B)

Results obtained in varying the final cold reduction in process (3), wherein the intermediate anneal was at a high temperature (700°C.) are listed in Table IV.

TABLE IV

| FCR | A | C |
|---|---|---|
| 10% | Exaggerated Grain Growth | |
| 15% | 66/29/49 | 63/22/50 |
| 25% | 69/32/46 | 67/27/50 |
| 40% | 71/36/43 | 68/29/52 |
| 50% | Exaggerated Grain Growth | |

Except for the 10% and 50% FCR samples, the grain sizes were uniform and less than 0.030 mm.

The data of Tables III and IV show conclusively that a high temperature intermediate anneal, at above 600°C., brings about a significant increase in the ductility of the final product, as compared to the product of a procedure which is identical except for the use of a low temperature intermediate anneal. Further, it is evident that increasing the intermediate annealing temperature to above 600°C. brings about a significant increase in the permissible range of the final cold reduction.

EXAMPLE III

This example is devoted to comparative tests of the effects of variations in the intermediate cold reduction step based on process sequence (3), as follows: CR 45%, 575°C., ICR, 700°C., CR 15%, 700°C.

Data in Example II (B) have established the obtainment of excellent results for this sequence with ICR of 30%. However, the use of ICR values of 10% and of 45% resulted in final strip products characterized by some objectionable exaggerated grain growth, also at times referred to as duplex structure, which is invariably accompanied by non-uniform values of elongation and tensile properties as well as undesirable finished appearance.

Accordingly, the operative limits of the intermediate cold reduction step for use with the CDA 688 type of grain-refined copper-zinc-aluminum alloys were established at 15 to 40%.

The results of the above examples illustrate clearly the critical nature of the intermediate and final cold reductions and annealing temperatures in accordance with this invention.

While the invention has been described with reference to a single final cold reduction and anneal, it should be evident from the above that a series of cold reductions and anneals within the ranges of the final cold reduction and anneal could be employed without subjecting the alloy to irregular grain growth. This invention, therefore, also covers such a sequence of a plurality of reductions and anneals within the ranges of the final reduction and anneal.

This invention may be embodied in other forms or carried out in other ways without departing from the spirit or essential characteristics thereof. The preferred embodiments are therefore to be considered as illustrative and not restrictive, the scope of the invention being indicated by the appended claims, and modifications which come within their spirit and scope of equivalency are intended to be embraced therein.

What is claimed is:

1. A process for improving the elongation of copper base alloys by controlled grain coarsening comprising:

providing a copper base alloy containing about 2 to 4.5% aluminum, 15 to 31% zinc, and a grain refining element selected from the group consisting of iron about 0.001 to 3%, chromium about 0.001 to 1%, zirconium about 0.001 to 1.0%, cobalt about 0.001 to 3.0%, and mixtures of these elements, and balance essentially copper, said alloy being in the annealed condition;

subjecting said alloy to a cold reduction of about 15 to 40%;

then annealing said alloy at a temperature of about 625° to 725°C.;

subjecting said alloy to a final cold reduction of 12 to 45%; and then final annealing said alloy at a temperature of about 600° to about 725°C.

2. A process as in claim 1 wherein the aluminum content is about 3 to 4%.

3. A process according to claim 2 wherein said alloy contains 72.3 to 74.7% copper, 3.0 to 3.8% aluminum, 0.25 to 0.55% cobalt, and the balance essentially zinc.

4. A process according to claim 3 wherein the final cold reduction is about 12 to 45%.

5. A process according to claim 3 wherein the final annealing temperature is about 625° to 725°C.

6. A process for improving the elongation of copper base alloys by controlled grain coarsening comprising:

A. providing a copper base alloy containing about 2 to 4.5% aluminum, 15 to 31% zinc, and a grain refining element selected from the group consisting of iron about 0.001 to 3%, chromium about 0.001 to 1%, zirconium about 0.001 to 1%, cobalt about 0.001 to 3% and mixtures of these elements, and balance essentially copper, said alloy being in the annealed condition;

B. cold reducing said alloy 20 to 35%;

C. then intermediate annealing said alloy at a temperature of about 650° to 700°C.;

D. then finally cold reducing said alloy about 15 to 35%; and

E. then finally annealing said alloy at a temperature of about 675° to 725°C.

7. A process as in claim 6 wherein the aluminum content is about 3 to 4%.

8. A process as in claim 6 wherein said alloy contains 72.3 to 74.7% copper, 3.0 to 3.8% aluminum, 0.25 to 0.55% cobalt, and the balance essentially zinc.

9. A process as in claim 6 wherein the cold reduction in Step B is about 30% and the intermediate annealing temperature in Step C is about 700°C.

10. A process as in claim 6 wherein the final cold reduction of Step D is about 20 to 30%.

11. A process for improving the elongation of copper base alloys by controlled grain coarsening comprising:

A. providing a copper base alloy containing about 2 to 4.5% aluminum, 15 to 31% zinc, and a grain refining element selected from the group consisting of iron about 0.001 to 3%, chromium about 0.001 to 1%, zirconium about 0.001 to 1%, cobalt about 0.001 to 3%, and mixtures of these elements, and balance essentially copper, said alloy being in the annealed condition;

B. cold reducing said alloy 10 to 70% so that it will recrystallize at a temperature of less than about 600°C.;

C. then intermediate annealing said alloy at a temperature of about 400° to 600°C.;

D. then cold reducing said alloy from about 15 to 40%;

E. then intermediate annealing said alloy at a temperature of about 625° to 725°C;

F. then finally cold reducing the alloy about 12 to 45%; and

G. then finally annealing said alloy from Step F at a temperature of about 600° to 725°C.

12. A process as in claim 11 wherein the aluminum content is about 3 to 4%.

13. A process according to claim 11 wherein said alloy contains 72.3 to 74.7% copper, 3.0 to 3.8% aluminum, 0.25 to 0.55% cobalt, and the balance essentially zinc.

14. A process as in claim 11 wherein the cold reduction in Step B is at least 30% and wherein the annealing temperature in Step E is about 650° to 700°C.

15. A process as in claim 11 wherein the cold reduction in Step F is about 20 to 30% and wherein the annealing temperature in Step G is about 700°C.

* * * * *